United States Patent [19]

Zalewski

[11] 3,937,464

[45] Feb. 10, 1976

[54] BATTING PRACTICE APPARATUS

[76] Inventor: Casimir Zalewski, 19835 W. Pheasant Run Drive, New Berlin, Wis. 53151

[22] Filed: June 19, 1974

[21] Appl. No.: 480,778

[52] U.S. Cl. ..... 273/26 R

[51] Int. Cl.[2] ..... A63B 69/40

[58] Field of Search ..... 273/26 R, 29 A, 177 B, 273/177 A, 184 B, 181 J, 185 D, 191 A, 191 R, 95 A, 200 A, 200 B, 55 R, 186 C; 272/76, 79 R, 79 B, 78, 82, 77, DIG. 5; 73/380, 492

[56] References Cited

UNITED STATES PATENTS

| | | | |
|---|---|---|---|
| 1,581,402 | 4/1926 | Penfrase | 273/200 B |
| 1,881,384 | 10/1932 | Albera | 273/26 R |
| 2,440,577 | 4/1948 | Denby | 273/55 R |
| 2,985,452 | 5/1961 | Trippet | 273/26 R |
| 3,262,703 | 7/1966 | Hodlick | 273/95 A |
| 3,324,726 | 6/1967 | Turczynski | 273/184 B |
| 3,367,655 | 2/1968 | Nauran | 273/95 A |
| 3,375,010 | 3/1968 | Panza | 273/186 C |
| 3,452,990 | 7/1969 | Nichols | 273/185 D |
| 3,533,624 | 10/1970 | Miller et al. | 273/55 R |

*Primary Examiner*—Richard J. Apley
*Assistant Examiner*—T. Brown
*Attorney, Agent, or Firm*—Joseph P. House, Jr.

[57] ABSTRACT

A ball is slidably mounted on a horizontally extending track which is supported by a tripod. The tripod has an upwardly extending post and a support arm which is adjustably attached to the post and extends transversely therefrom. The support arm is adjustably attached to the track to support the same. An upper rail is spaced above the track and extends parallel thereto to form an open ended bat guideway. The ball is mounted on a carriage which slides within the guideway and is spring biased to normally hold the ball in the open end of the guideway. The position of the ball and orientation of the guideway with respect to a batter can be easily adjusted to be disposed at any desired position within an individual batter's strike zone by the adjustments on the tripod and support arm. When the bat is properly swung, it hits the ball squarely and knocks the ball down the guideway to the end of the track, where the ball carriage strikes a resilient bumper. The bat moves through the guideway without touching its boundaries and then leaves the guideway. The ball subsequently returns to the open end of the guideway under the influence of the spring biasing means. If the ball is not hit squarely, it will not travel all the way to the end of the track. If the bat is swung at the wrong angle, it will contact the track or the upper rail, thereby giving the batter notice of an improper swing. If the swing is grossly incorrect, the bat may miss the ball and the guideway entirely and strike resilient bumpers at the open end of the guideway. At least one leg of the tripod support is preferably wheeled so that the apparatus may be easily moved from place to place.

15 Claims, 7 Drawing Figures

BATTING PRACTICE APPARATUS

BACKGROUND OF THE INVENTION

This invention improves on batting practice apparatus such as disclosed in U.S. Pat. Nos. 2,818,255 to L. J. Ponza; 2,985,452 to W. A. Trippet and 3,386,733 to A. F. Russo et al.

SUMMARY OF THE INVENTION

The physical structure of the invention is summarized in the foregoing Abstract of the Disclosure.

With the batting apparatus of this invention, the better stands in any position that is comfortable for him and begins his swing. The important consideration here is point of impact and follow through.

Some of the main points of interest of this invention are, as confidence of batter increases in the art of swinging the bat at the ball and through the guides the weight of the ball can be increased so that the force with which he hits at the ball can be ever increased, thereby developing also a powerful follow-through. In the science of hitting a baseball the most important practice aspect is repetition. With this invention the batter can position his body in relationship to the unit so that he may practice hitting any pitch he wishes repeatedly until he has that pitch mastered and then his reflexes are preconditioned to react to that pitch and any other he chooses to practice on. This is called preconditioned reflex action and is the single most important skill a batter can possess. A very limited number of ball players possess this skill naturally, however, the great majority do not and not until now was it possible to teach that skill with the batting practice apparatus of this invention.

This invention is unique in that the ball can be struck by a batter from his normal and comfortable stance and offers sufficient resistance to the bat so that the batter is given a challenge to contend with. When the batter becomes proficient enough to strike the ball with confidence so that the ball travels along the rail away from him and the bat passes through the unit guides, the ball may then be weighted by pressure springs or any other method so that the power of the follow-through may be developed in the same way as a weight lifter develops strength through repetition and added weights and this same repetitious action can be practiced at any level and any position with relationship to inside or outside swings. The theory at this juncture is that a perfectly level swing, contrary to popular belief, is not the most desirable swing. However, the position of the bat, horizontal to the ground, at point of impact with the ball, is the most desirable level. After sufficient practice, this invention helps the batter keep the level of the bat constant and more level than the normal swing, thereby increasing the percentage of line drive hits to all fields and minimizing the importance of timing.

After the ball is struck properly, it slides along the rail in the direction that a normal baseball would travel if it were hit by a bat in the same position. The ball always returns to its original position after the batter has hit it properly and followed through. If the ball is hit improperly it only travels a short distance and then returns to its original position, simulating the travel of a normal baseball if it is not hit solidly and properly. Therefore, the batter knows at once if he is hitting a ball properly in any area of his own personal strike zone. At this point he can swing at the ball repeatedly until he perfects every area of his swing in his own individual strike zone.

The apparatus of this invention is not designed to make all batters swing the same way. It is designed to let every batter develop his own style and learn to hit the ball properly with his own style. That is how the apparatus of this invention differs from any other type of batting equipment. It takes into account that every one is an individual.

One object of this invention is to provide apparatus for teaching a batter to swing a bat and develop a preconditioned reflex action adapted to the batter's own individual stance and style.

Another object of this invention is to provide batting practice apparatus which can be easily adjusted to place a stationary ball at any desired position within a batter's individual strike zone.

Another object of this invention is to provide batting practice apparatus which can be easily adjusted to change the height and angular orientation of a guideway through which a bat may be swung.

A further object of this invention is to provide batting practice apparatus which includes both a guideway through which a bat may be swung and a ball slidably mounted within the guideway to be struck by the bat.

An additional object of this invention is to provide batting practice apparatus which is portable and may be easily moved from place to place.

Another object of this invention is to provide batting practice apparatus which is simple and sturdy in structure and reliable in operation.

Other objects, advantages, and features of this invention will become apparent to those skilled in the art from the description hereof.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
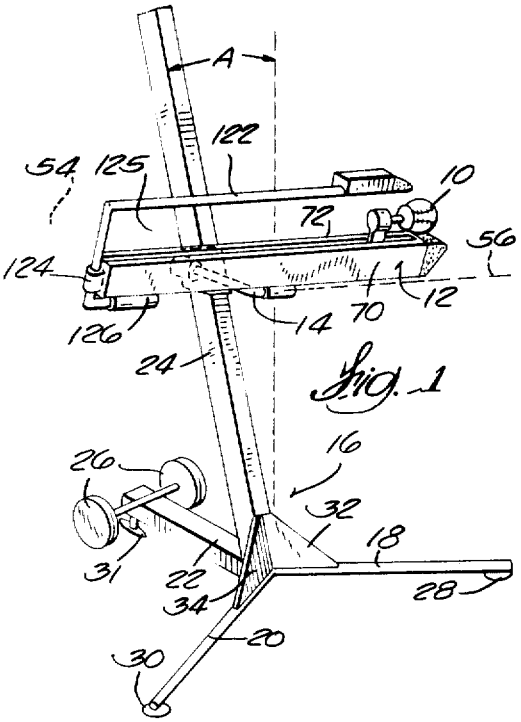
FIG. 1 is a perspective view of one embodiment of the invention.

Referring to FIG. 1, a ball 10 is slidably mounted on a horizontally extending track 12 which is adjustably supported by a support arm 14. The support arm 14 is in turn adjustably supported by a tripod 16 which includes three metal legs 18, 20 and 22. In this particular embodiment, post 24 is rectangular in shape, but it may be cylindrical if desired. Post 24 is tilted at an angle A to the vertical and slopes toward leg 22, which is heavier than the other two legs 18 and 20 to provide support for post 24. A pair of wheels 26 are preferably journaled to the end of leg 22 for conveniently moving the apparatus from place to place. Disks or skids 28, 30 and 31 are attached to the ends of legs 18, 20, and 22 to prevent the ends of legs 18, 20, and 22 from digging into the ground and serve as shock absorbers. Gussets 32 and 34 are welded between post 24 and legs 18 and 20 respectively to help support legs 18 and 20. The angle A at which post 24 is inclined to the vertical is selected to provide adequate clearance between post 24 and a bat which is swung at the apparatus, as described hereinafter, and to provide for stability of the unit.

Figure 4:
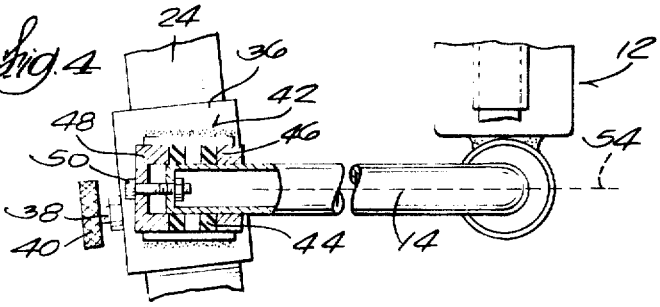
FIG. 4 is a detail side view of the arm which supports the structure shown in FIGS. 2 and 3.
Figure 7:
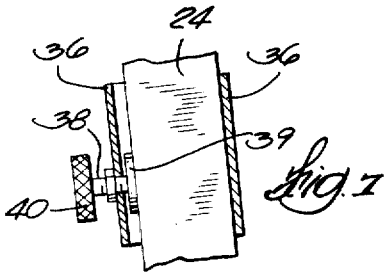
FIG. 7 is a detail longitudinal sectional view of the mounting sleeve shown in FIG. 4.

The means by which support arm 14 is adjustably attached to post 24 is best shown in FIGS. 4 and 7. Referring to FIGS. 4 and 7, a hollow, rectilinear sleeve 36 is slidable up and down post 24 and can be fixed in place at any desired height on post 24 by a set screw 38 which applies pressure to plate 39 (FIG. 7) to prevent sleeve 36 from slipping. Set screw 38 has a knurled head 40 that is of a size to be easily grasped by the thumb and fingers. A hollow, cylindrical sleeve 42 is welded to one side of sleeve 36. Cylindrical sleeve 42 is substantially larger in diameter than support arm 14 and contains a plurality of resilient clamping rings or washers 44 which are spaced between the outside surface of support arm 14 and the inside surface of sleeve 42. A fixed abutment ring 46 is welded to support arm 14 and bears against one end of the adjacent resilient clamping washers 44. A movable abutment ring 48 is mounted adjacent to the opposing ends of resilient clamping washers 44 and may be moved toward and away from the fixed abutment ring 46 by a clamping screw 50 which engages a threaded plug 52 in the end of support arm 14. When screw 50 is tightened, it squeezes the resilient clamping washers 44 between the fixed abutment ring 46 and the movable abutment ring 48. This causes the resilient washers 44 to expand radially both inwardly and outwardly and to resiliently clamp the inner surface of sleeve 42 against the outer surface of support arm 14. When screw 50 is loosened, it allows the resilient clamping washers 44 to contract radially and free support arm 14 for rotation about the axis 54. When the support arm 14 is in the desired position, it may be clamped in position by tightening screw 50 as described above.

Figure 2:
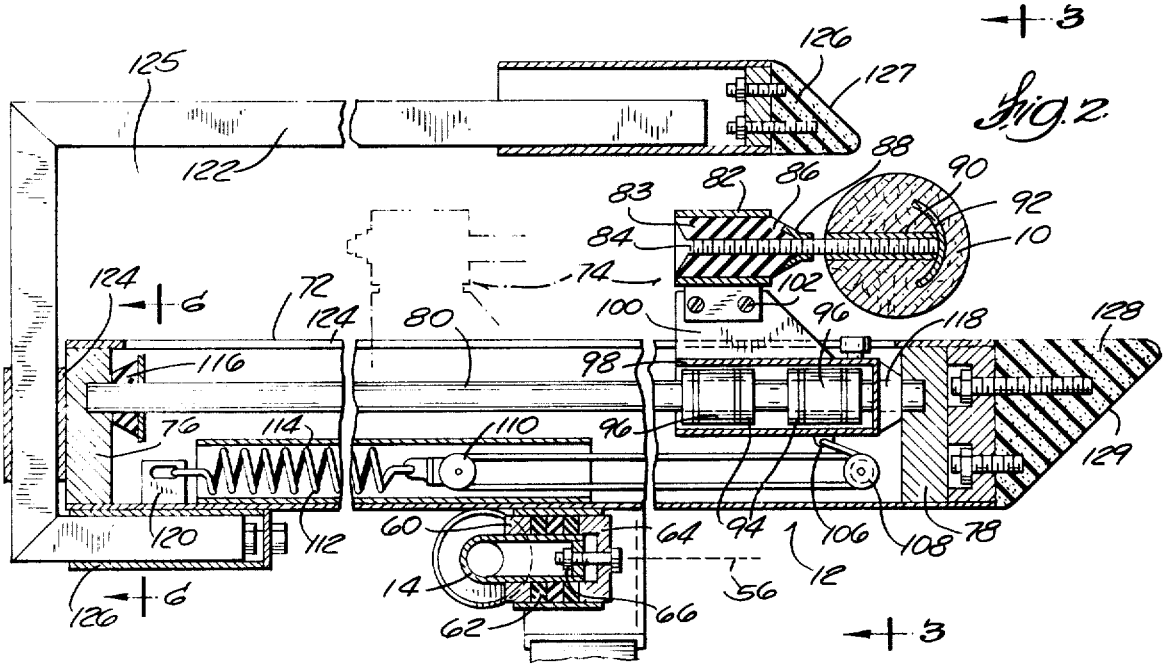
FIG. 2 is a longitudinal sectional view of the structure which slidably supports the ball in FIG. 1 and forms the bat channel.

At its other end, support arm 14 is bent at right angles and extends along an axis 56 (FIGS. 1 and 2) which is substantially parallel to the track 12. This end of arm 14 enters the interior of a clamping mechanism which includes a hollow cylindrical sleeve 58, a fixed abutment ring 60, a plurality of resilient clamping washers 62, a movable abutment ring 64, and a clamping screw 66 which engages a threaded plug 68 in the end of support arm 14. This clamping mechanism operates in the same manner as the previously described clamping mechanism and serves to clamp the track 12 at any desired angular orientation about axis 56.

Figure 3:
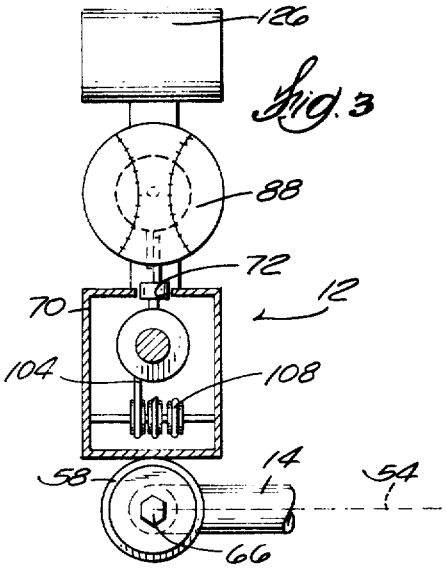
FIG. 3 is a cross sectional view taken on the line 3—3 of FIG. 2.

The track 12 includes a hollow, rectilinear housing 70 which is slotted at 72 (FIG. 3) to allow a ball carriage 74 to project therethrough. A rear end plug 76 (FIG. 2) and a front end plug 78 are attached to the two ends of housing 70. A lower cylindrical rail 80 is supported at its ends by the end plugs 76 and 78. The ball carriage 74 slides back and forth on lower rail 80 as described hereinafter.

The upper portion of ball carriage 74 includes a hollow cylindrical sleeve 82 which is filled with a resilient material 83, such as rubber. A threaded rod 84 is embedded in the resilient material 83 and extends axially therethrough and outwardly therefrom to the right in FIG. 2. The resilient material 83 is preferably bulged outwardly at 86 toward the ball 10 to better absorb the shock of the ball 10 being struck. A conically shaped shield 88 is engaged on rod 84 by screw threads and bears against the bulged portion 86 to distribute the force of the struck ball 10 against bulged portion 86. The ball 10 is preferably made of a resilient material such as rubber and has a hollow, cylindrical, threaded tube 90 embedded therein to mount the ball 10 on the rod 84. A semispherical plate 92 is rigidly attached to the end of tube 90 to prevent the end of the tube from cutting through the ball 10 when it is struck by a bat. Plate 92 transmits the force of the bat to tube 90 which is screwed onto the exposed end of threaded rod 84. From rod 84, the force is transmitted to conical shield 88 and from there to the resilient material 83, which deforms to absorb the shock.

The lower portion of ball carriage 74 includes two bushing sleeves 94 which are slidably engaged with the lower rail 80. Resilient washers 96 are fitted over bushing sleeves 94 to act as resilient fasteners to secure a sleeve 98 on the bushing sleeves 94. A support plate 100 is welded to the top of sleeve 98 and is attached by means of bolts 102 to the upper portion of ball carriage 74. When ball 10 is struck by a bat, the force is communicated to the bottom of ball carriage 74 and causes bushing sleeves 94 to slide along rail 80. Resilient material 83 and 96 and clamping rings 44 and 62 and resilient feet 28, 30 and 31 cushion the shock of the bat impact and protect the assembly from shock damage.

A cord 104 is attached at one end of a lug 106 on the bottom of sleeve 98. Cord 104 is threaded around a first set of pulleys 108 which are attached to housing 70 and a second set of pulleys 110 which are attached to the end of an expansion spring 112. Pulleys 110 and expansion spring 112 are enclosed by a hollow tube 114 which acts as a guide and noise deadener. When ball 10 is struck by a bat, ball carriage 74 slides down lower rail 80 and draws cord 104 toward the left-hand side of FIG. 2. This causes spring 112 to expand and develops a spring biasing force tending to return ball carriage 74 to its rest position which is illustrated in solid lines in FIG. 2. When the ball carriage 74 reaches the left-hand end of lower rail 80 in FIG. 2, it bumps against a resilient bumper 116 which stops ball carriage 74 and absorbs the shock of stopping. The ball carriage 74 is then drawn back toward its original position by the force of expanded spring 112. When ball carriage 74 reaches its rest position, a resilient bumper 118 on the end of sleeve 98 contacts the end wall 78, thus stopping ball carriage 74 again and absorbing the shock of stopping.

Figure 6:
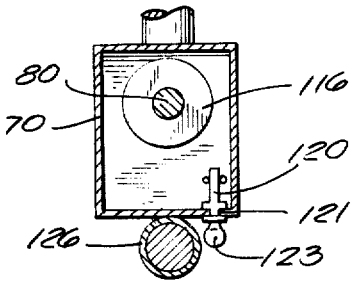
FIG. 6 is a cross-sectional view taken on the line 6—6 of FIG. 2.

The fixed end of spring 112 is hooked in an opening in a lug 120 which is T-shaped at its bottom end and extends through a slot 121 in the bottom of housing 70 (FIG. 6) and can be clamped in any fixed position along slot 121 by a thumb screw 123. This allows the force exerted by spring 112 on ball carriage 74 to be varied by varying the position at which lug 120 is clamped by thumb screw 123 along the slot 121.

An upper rail 122 is attached at 124 and 126 to the housing 70 of track 12 and extends in spaced parallel relation to track 12 thereabove. The upper slotted surface 124 of housing 70 and upper rail 122 comprise means defining a linear guideway 125 through which a bat may pass. The ball 10 is normally positioned in the open front end of the guideway and resilient bumpers 126 and 128 are fitted on the ends of track 12 and upper rail 126 by suitable fastening means. Resilient bumpers 126 and 128 protect the open front end of the structure and absorb the shock when the bat strikes the front end of the structure.

Figure 5:
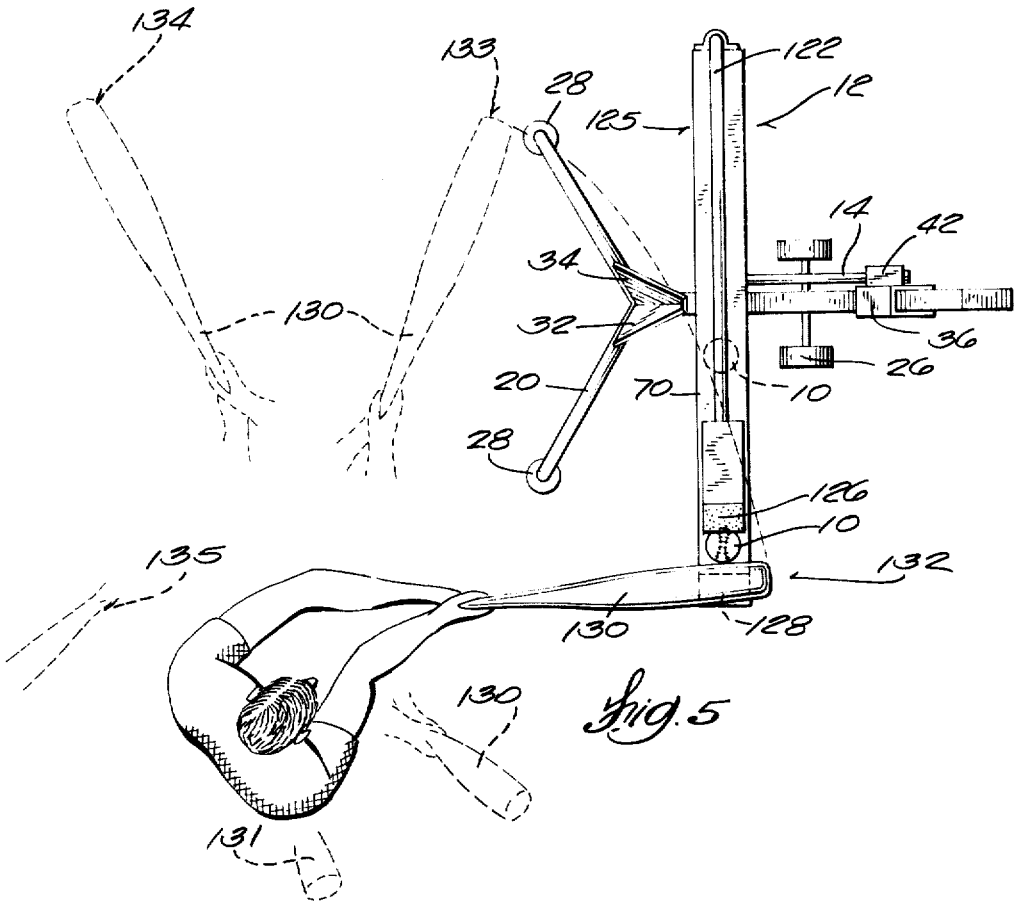
FIG. 5 is a top view of the apparatus disclosed in FIGS. 1–4 as it is used for batting practice.

Before the batting practice apparatus of this invention is used, it is adjusted to place the ball 10 and guideway 125 in a predetermined position in the individual batter's strike zone. The position depends upon whether the batter wishes to practice swinging at high balls or low balls or balls in the center of the strike zone. The height of ball 10 and guideway 125 are adjusted by loosening knurled knob 40 (FIG. 4), sliding sleeve 36 to the desired height, then retightening screw 50. The angle of guideway 125 about axis 56 (FIG. 1) is adjusted by loosening screw 66 (FIG. 2), moving the track 12 to the desired angle, then retightening screw 66. These simple adjustments place the ball 10 at any desired position in the individual batter's strike zone with guideway 125 tilted at any desired angle relative to axes 54 and 56. The batter then addresses the batting practice apparatus and swings a bat 130 at ball 10 as shown in FIG. 5. As will be noted in FIG. 5, the guideway 125 is much shorter than the length of the batter's natural swing. This is important because it allows the batter to stand in a natural position and start his swing in a natural way before the bat 130 enters the guideway 125. If the bat 130 strikes ball 10 squarely, it will cause ball 10 to move all the way to the end of lower rail 80. The bat then passes through guideway 125 until it is clear of guideway 125 as indicated by the dashed lines in FIG. 5. If the bat 130 is swung at the proper angle, it will pass through guideway 125 without touching the boundaries thereof. However, if the angle of the swing is incorrect, the bat 130 will contact either the upper surface 124 of housing 70 or the lower surface of upper rail 122. This gives the batter notice that he is swinging incorrectly. If the ball 10 is not hit squarely, it will not go all the way to the rear end of the lower rail 80, but will rather fall short by an amount which depends upon the force of the blow to ball 10 and the spring constant of spring 112. The size of spring 112 may be selected according to circumstances to meet the requirements of a particular application. In general, the spring constant of spring 112 will be selected to be of such magnitude as to permit ball 10 to travel all the way to the rear end of lower rail 80 when it is struck squarely by the batter with a normal swing.

The amount of force exerted by spring 112 on ball carriage 74 depends upon the position of lug 120 along slot 121. (See FIG. 6.) This position can be adjusted manually by means of thumb screw 123 to increase or decrease the force on ball carriage 74 as desired. During batting practice, the force is gradually increased as the swing becomes grooved to develop a powerful follow-through.

If the batter does not strike ball 10 squarely, he will be able to tell that he has struck the ball incorrectly by the feel of the impact with the ball and by the fact that the ball does not slide all the way to the rear end of lower rail 80. The batter may then repeat the swing until he has it correct and then repeat the correct swing over and over to groove it into his muscular memory. The ball 10 and guideway 125 may then be readjusted to a different position in the batter's strike zone for further practice. If, in the course of practice, the batter's swing is grossly incorrect, he may miss the open front end of guideway 125 entirely and hit the resilient bumpers 126 and 128, whose outer surfaces 127 and 129 are preferably tapered at a 45° angle in such direction as to direct the bat away from the batting practice apparatus.

In FIG. 5 a typical starting position of the bat 130 is shown at 131. The position of the bat as it meets the ball 10 is shown at 132. Subsequent positions of the bat after it leaves the guideway 125 are shown at 133 and 134. The position of the bat at the end of the follow-through is shown at 135. The batter's natural swing extends in an arc from bat position 131 to bat position 135, almost a complete circle. The bat is within the guideway 125 for only a short arc, on the order of about ten per cent of the full swing. Thus the guideway does not interfere with the batter's swing and follow-through.

I claim:

1. Batting practice apparatus comprising a linear track, means supporting said linear track, a rail spaced laterally of said track and extending parallel thereto, said track and rail comprising means forming a bat receiving guideway open at its front end through which a bat may be swung, a ball, means slidably supporting said ball for movement along said track within said guideway, means normally urging said ball toward the open front end of said guideway and means for limiting the movement of said ball toward said open front end of said guideway, said means supporting said linear track comprising a post, a support arm adjustably attached to said post and extending transversely therefrom, and means attaching said support arm to said track for supporting the same.

2. The apparatus defined in claim 1 wherein said post is tilted at an angle to the vertical.

3. The apparatus defined in claim 2 wherein said support means further comprises a tripod having three legs, said post being tilted toward one leg of the tripod and wherein said one leg is larger than the other two legs of the tripod to better support said tilted post.

4. The apparatus defined in claim 1 and further comprising at least one wheel journaled to said support means for moving the apparatus from place to place.

5. The apparatus defined in claim 1 wherein said track includes a hollow rectilinear housing having a slotted top, and a second rail mounted within said housing under said slotted top, a ball carriage slidably mounted on said second rail and projecting upwardly through the slotted top of said housing, and resilient means attaching said ball to said ball carriage for slidably supporting the ball with respect to the housing, said ball carriage including a plate projecting upwardly through the slotted top of said housing and a hollow cylindrical sleeve attached to the top of said plate, and wherein said means attaching said ball to said ball carriage includes a cylinder of resilient material within said cylindrical sleeve and a threaded rod embedded at one end in said resilient material and attached at its other end to said ball.

6. The apparatus defined in claim 5 wherein said ball is made of resilient material and wherein a threaded tube is embedded in said ball, said threaded tube being of such dimensions as to receive said threaded rod and being threaded thereon, and further comprising a plate on one end of said tube to prevent the tube from cutting through said ball when the ball is struck by a bat.

7. Batting practice apparatus comprising a linear track, means supporting said linear track, a rail spaced laterally of said track and extending parallel thereto, said track and rail comprising means forming a bat receiving guideway open at its front end through which a bat may be swung, a ball, means slidably supporting said ball for movement along said track within said guideway, means normally urging said ball toward the open front end of said guideway and means for limiting the movement of said ball toward said open front end of said guideway, said means supporting said linear track including an upwardly extending post, a first sleeve slidably mounted on said post, a threaded bore in said first sleeve for receiving a set screw and clamping plate to hold said first sleeve at any desired height on said post, a second sleeve rigidly attached to said first sleeve and extending transversely thereto, a supporting arm passing through said second sleeve and projecting sideways therefrom, means for resiliently clamping said supporting arm in said second sleeve, the end of said supporting arm which is opposite said second sleeve being bent at an angle of approximately 90°, a third sleeve rigidly attached to the bottom of said linear track, the end of said supporting arm which is opposite said second sleeve being positioned within said third sleeve, and means for resiliently clamping said support arm in said third sleeve.

8. The apparatus defined in claim 7 wherein said means for resiliently clamping said supporting arm in said second sleeve comprises a plurality of resilient washers positioned between said supporting arm and said second sleeve, abutment means at one axial end of said plurality of washers for limiting the axial movement thereof, and means at the other axial end of said plurality of washers for applying axial pressure thereto to cause radial enlargement thereof, thereby resiliently clamping said supporting arm in said second sleeve.

9. The apparatus defined in claim 8 wherein said means for resiliently clamping said supporting arm in said third sleeve comprises a second plurality of resilient washers positioned between said support arm and said third sleeve, fourth abutment means at one axial end of said second plurality of washers for limiting the axial movement thereof, and means at the other axial end of said second plurality of washers for applying axial pressure thereto to cause radial enlargement thereof, thereby resiliently clamping said support arm in said third sleeve.

10. Apparatus for teaching a batter to swing a bat and develop a preconditioned reflex action adapted to the batter's individual stance and style, said apparatus comprising a bat swing guideway adapted to receive the ball hitting end of a bat swung by the batter, said guideway having an open front end, means for adjustably supporting said guideway at various levels and inclinations for matching the natural swing path for the particular batter using the apparatus so that the guideway will intercept the bat during swinging motion of the bat by the batter, a ball in said guideway and means slidably supporting the ball for movement along said guideway after impact with the bat, and means resisting movement of the ball along the guideway to develop the batter's follow-through.

11. The apparatus of claim 10 in which the means resisting movement of the ball along the guideway is adjustable, thus to permit gradually increasing such resistance as the batter's swing is perfected.

12. The apparatus of claim 11 in which said means comprises a spring, a spring anchor, and means for adjustably attaching the anchor to the guideway.

13. The apparatus of claim 12 and further comprising a linear track and a rail extending parallel thereto, the lower boundary of said guideway being formed by the upper surface of said track and the upper boundary of said guideway being formed by the lower surface of said rail, a ball carriage slidably mounted on said linear track, means attaching said ball to said ball carriage, said spring being attached at one end to said ball carriage and being attached at its other end to said spring anchor, and means adjustably attaching said spring anchor to said linear track whereby the force exerted by said spring on said ball carriage may be adjusted.

14. The apparatus of claim 13 wherein the upper surface of said linear track is slotted and wherein said ball carriage is slidably mounted in said slot in the upper surface of said linear track, said linear track being hollow and said spring being mounted within said linear track, the lower surface of said linear track being slotted and said spring anchor being shaped to extend through said slot in the lower surface of said track, and a thumb screw attached to the bottom of said spring anchor for adjustably securing said spring anchor to the slotted bottom of said track.

15. The apparatus of claim 10 wherein said means supporting said guideway includes an upwardly extending post, a first sleeve slidably mounted on said post, a threaded bore in said first sleeve for receiving a set screw to hold said first sleeve at any desired height on said post, a second sleeve rigidly attached to said first sleeve and extending transversely thereto, a supporting arm passing through said second sleeve and projecting transversely therefrom, means for resiliently clamping said supporting arm in said second sleeve, the end of said supporting arm which is opposite said second sleeve being bent at an angle of approximately 90°, a third sleeve rigidly attached to the bottom of said guideway, the end of said supporting arm which is opposite said second sleeve being positioned within said third sleeve, and means for resiliently clamping said support arm in said third sleeve.

* * * * *